US009611840B2

(12) United States Patent
Celotta et al.

(10) Patent No.: US 9,611,840 B2
(45) Date of Patent: Apr. 4, 2017

(54) OFFSET CAM FOR PISTON PUMP

(75) Inventors: Daniel W. Celotta, Circle Pines, MN (US); John C. Holman, Ham Lake, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 974 days.

(21) Appl. No.: 13/698,935

(22) PCT Filed: May 19, 2011

(86) PCT No.: PCT/US2011/000894
§ 371 (c)(1),
(2), (4) Date: Nov. 19, 2012

(87) PCT Pub. No.: WO2011/146126
PCT Pub. Date: Nov. 24, 2011

(65) Prior Publication Data

US 2013/0061744 A1 Mar. 14, 2013

Related U.S. Application Data

(60) Provisional application No. 61/346,280, filed on May 19, 2010.

(51) Int. Cl.

| | |
|---|---|
| ***F16D 31/02*** | (2006.01) |
| ***F04B 9/04*** | (2006.01) |
| ***F04B 53/16*** | (2006.01) |
| ***F04B 1/04*** | (2006.01) |

(52) U.S. Cl.
CPC ..... *F04B 9/042* (2013.01); *F04B 1/0408* (2013.01); *F04B 1/0413* (2013.01); *F04B 9/045* (2013.01); *F04B 53/16* (2013.01); *F04B 53/162* (2013.01)

(58) Field of Classification Search
CPC ..... F04B 9/45; F04B 53/16; F04B 53/162; F04B 53/164
USPC ..... 60/412
See application file for complete search history.

(56) References Cited

U.S. PATENT DOCUMENTS

| | | | |
|---|---|---|---|
| 4,308,839 | A | 1/1982 | Hafner et al. |
| 5,378,123 | A | 1/1995 | Scuderi et al. |
| 6,647,935 | B2 | 11/2003 | Aoyama et al. |
| 7,179,064 | B2 | 2/2007 | Folchert |

(Continued)

FOREIGN PATENT DOCUMENTS

| | | | |
|---|---|---|---|
| CN | 101641535 | A | 2/2010 |
| CN | 101644242 | A | 2/2010 |

(Continued)

OTHER PUBLICATIONS

Chinese Office Action from CN Application Serial No. 201180024749.4, dated Sep. 25, 2014, 15 pages.

(Continued)

*Primary Examiner* — Thomas E Lazo
*Assistant Examiner* — Daniel Collins
(74) *Attorney, Agent, or Firm* — Kinney & Lange, P.A.

(57) ABSTRACT

A pump assembly comprises a cam and a piston. The cam rotates in a plane about an eccentric axis, and has a circumferential side wall. The piston engages the circumferential side wall of the cam, and runs along a piston axis which lies in the plane of the cam. The piston axis is parallel to but not coincident with a reference line perpendicular to and intersecting the eccentric axis.

10 Claims, 4 Drawing Sheets

(56) References Cited

U.S. PATENT DOCUMENTS

2008/0295807 A1* 12/2008 Bauer et al. ..... 123/495

FOREIGN PATENT DOCUMENTS

| | | | |
|---|---|---|---|
| DE | 4310062 | A1 | 9/1994 |
| DE | 10236853 | A1 | 2/2004 |
| DE | 102008002101 | A1 | 12/2009 |
| DE | 102008042881 | A1 | 4/2010 |
| EP | 0687814 | A2 | 12/1995 |
| GB | 2016078 | A | 9/1979 |
| JP | H07317652 | A | 12/1995 |
| RU | 45479 | U1 | 5/2005 |
| SU | 1679051 | A1 | 9/1991 |

OTHER PUBLICATIONS

Russian Office Action from Russian Application Serial No. 2012155000, dated Jan. 23, 2015, 7 pages.
International Search Report and Written Opinion for PCT Application Serial No. PCT/US2011/000894, dated Jan. 18, 2012, 7 pages.
Extended European Search Report for EP Application No. 11783869.8, dated Oct. 27, 2015, 7 pages.

* cited by examiner

OFFSET CAM FOR PISTON PUMP

BACKGROUND

The present invention relates generally to piston pumps, and more particularly to piston pumps driven by a rotating cam.

Piston pumps are commonly used to move fluids such as oil or grease in a wide range of industrial and automotive applications. Piston pumps driven by a rotating cam pump an approximately constant amount of fluid with each rotation of the cam.

Piston pumps driven by rotating cams comprise three parts: a cam, a piston engaged with the cam, and a cylinder containing the piston. Cams can be circular, elliptical, or irregularly shaped discs, but in all cases exert a force on the piston as the cam rotates. The piston of a piston pump is typically constrained to move along a straight path inside the cylinder, and is retained against an outer circumferential surface of the cam. The cylinder of a piston pump constrains the piston, and provides a pumping chamber into which fluid is drawn, and from which fluid is pumped by movement of the piston. Many pistons are substantially cylindrical shafts, and most cylinders are substantially cylindrical tubes. Piston cylinders include inlet ports which allow fluid to enter the pumping chamber. These ports are typically holes in the sides of the cylinder.

As the cam of a piston pump rotates, the piston is pushed back and forth inside the cylinder with the assistance of a spring, towards and away from the cam. The cam pushes the piston into the cylinder, and the spring returns the piston when the cam retreats. This reciprocating motion of the piston opens and closes at least one port in the piston cylinder by unblocking and blocking the port. While the piston withdraws, fluid flows through the open port into the pumping chamber of the cylinder. When the piston extends, it blocks the port and forces fluid trapped in the pumping chamber out through a pump outlet.

In cam-driven piston pumps, the piston is conventionally aligned with the cam such that the shaft of the piston extends radially outward from the axis of rotation of the cam. This results in the piston pumping for half of the rotation of the cam, and the cylinder filling for the other half of the rotation of the cam. Many cams apply force to pistons by rotating about an eccentrically-located axis. Such cams apply forces to radially oriented pistons which are not entirely along the direction of motion of the piston.

SUMMARY

The present invention is directed toward a pump assembly with a cam and a piston. The cam rotates in a plane about an eccentric axis, and has a circumferential side wall. The piston engages the circumferential side wall of the cam, and runs along a piston axis which lies in the plane of the cam. The piston axis is parallel to but not coincident with a reference line perpendicular to and intersecting the eccentric axis.

DETAILED DESCRIPTION

Figure 1:
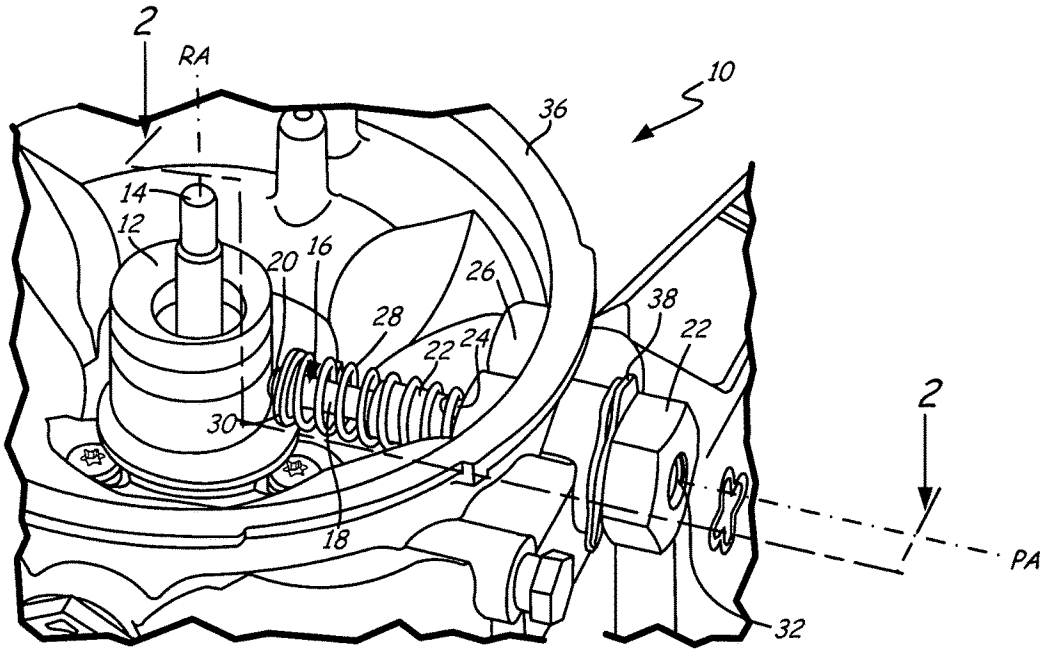
FIG. 1 is a perspective view of a pump assembly of the present invention, including a cam, a piston in contact with the cam, and a cylinder in which the piston rides.

FIG. 1 is a perspective view of pump assembly 10, comprising cam 12, driveshaft 14, piston 16 (with straight shaft 18 and can follower 20), cylinder 22, port 24, base 26, piston spring 28, piston spring platform 30, outlet 32, reservoir attachment ring 36, and shim clips 38. Cam 12 is a disc with an outer circumferential wall and an eccentric axis of rotation, such as a circular disk with an axis of rotation offset from the geometric center of the circle. Driveshaft 14 is a rotatable shaft anchored to cam 12 through axis of rotation RA. Piston 16 is a rigid piston which rides cam 12. Piston 16 comprises straight shaft 18 and cam follower 20, which is slightly rounded. Cylinder 22 is a substantially cylindrical tube retaining piston 16 such that straight shaft 18 forms a seal with the interior of cylinder 22. Cylinder 22 features at least one port 24. As shown, port 24 is a hole through both sides of cylinder 22. Base 26 is a rigid body which anchors both driveshaft 14 and cylinder 22. In the depicted embodiment, base 26 is an injection molded plastic piece, but base 26 may generally be any structure which anchors cylinder 22 relative to driveshaft 14. Cylinder 22 is threaded into base 26. In other embodiments, cylinder 22 may be removably attached to base 26 by other means. Piston spring 28 extends between cylinder 22 and piston spring platform 30, which is a disc mounted on piston 16, near cam follower 20. Cylinder 22 includes outlet 32, an exit point for fluid such as fuel, oil, or grease. Outlet 32 has a threaded interior surface for attaching a hose or tube to carry fluid. In alternative embodiments, hoses or tubes may be attached to outlet 32 by other means. A fluid reservoir (not shown) is anchored atop pump assembly 10 at reservoir attachment ring 36. Together with base 26, this reservoir forms a space which can be filled with fluid. Shim clips 38 are clips of a predetermined width, and may, for instance, be formed of stamped metal. Shim clips 38 can be inserted between cylinder 22 and base 26, as shown, to adjust the position of port 24 relative to axis of rotation RA. Inserting or removing shim clips 38 alters the displacement of pump assembly 10, as described in co-pending non-provisional application Ser. No. 13/698,943 entitled "REMOVABLE SHIM CLIP FOR ADJUSTABLE PISTON PUMP." Pump assembly 10 can be used in any suitable system, such as in commercial and industrial lube systems.

Driveshaft 14 rotates under power to turn cam 12. For example, driveshaft 14 may rotate under power from an air motor or an electric motor. As cam 12 turns about eccentric axis of rotation RA, piston spring 28 retains cam follower 20 of piston 16 against the outer circumferential wall of cam 12 via spring force. As cam 12 rotates, it exerts a force on piston 16, compressing piston spring 28. As cam 12 continues to rotate, piston spring 28 keeps cam follower 20 in contact with cam 12 while the outer circumferential wall of cam 12 recedes. Straight shaft 18 of piston 16 travels back and forth along piston axis PA (see FIG. 2), through cylinder 22, driven by cam 12.

Fluid from the reservoir anchored at reservoir attachment ring 36 fills the region surrounding cam 12, piston 16, and cylinder 22. As cam 12 turns, piston 16 translates along a path defined by cylinder 22. Motion of piston 16 to the left creates a vacuum void within cylinder 22 while port 24 is closed (see FIG. 2). When port 24 opens, this vacuum draws fluid into cylinder 22 through port 24. Motion of piston 16 to the right drives fluid out of cylinder 22 via outlet 32, thereby pumping fluid out of the reservoir. To maximize pumping efficiency, the axis of piston 16 does not intersect axis of rotation RA, but instead is displaced a fixed distance into the direction of rotation of cam 12, as will be described in further detail with respect to FIG. 2.

Figure 2:
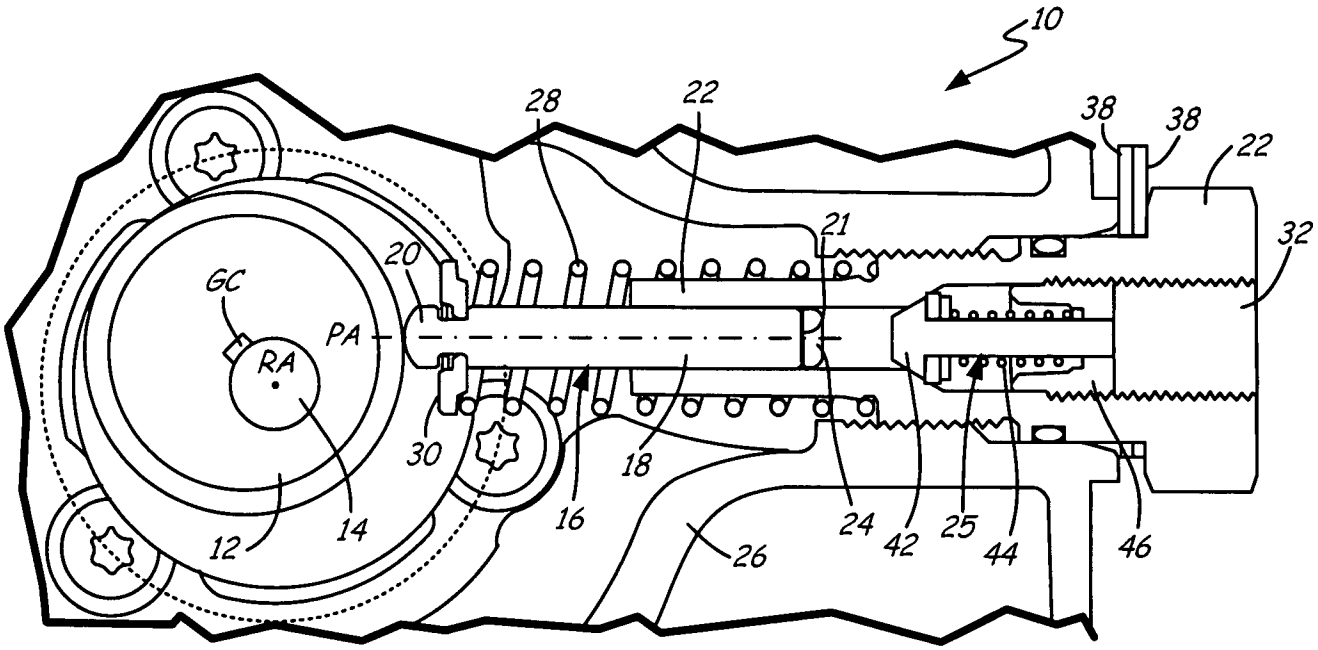
FIG. 2 is a cross-sectional view of the pump assembly of FIG. 1.

FIG. 2 is a cross-sectional view of pump assembly 10 through section line 2-2 of FIG. 1. FIG. 2 depicts cam 12, driveshaft 14, piston 16 (with straight shaft 18, cam follower 20, and piston face 21), cylinder 22, port 24, valve 25, base 26, piston spring 28, piston spring platform 30, outlet 32, shim clips 38, plug 42, valve spring 44, and valve spring platform 46. As described with respect to FIG. 1, driveshaft 14 rotates cam 12, and is anchored to base 26. Piston 16 slides within cylinder 22 and is retained against cam 12 by spring 28, reciprocating along piston axis PA. Cylinder 22 has port 24 through which fluid enters cylinder 22, and outlet 32 through which fluid exits cylinder 22. In addition, valve 25 forms a seal within cylinder 22. Valve 25 is a poppet valve comprising plug 42, plug spring 44, and plug spring platform 46. Plug 42 is a plug shaped and sized to seal cylinder 22 against fluid passage when retained in place (as shown) by valve spring 44. Valve spring 44 is a low strength spring which extends from plug 42 to plug spring platform 46, and restores plug 42 to a sealing position in the absence of other forces. Plug spring platform 46 includes holes or fluid passages (not shown) to allow fluid to flow through spring platform 46 toward outlet 32. In one embodiment, plug spring platform 46 is threaded to fit into threads in outlet 32.

Rotation of cam 12 drives piston 16 back and forth along piston axis PA, as described previously. Straight shaft 18 sometimes blocks port 24, closing port 24 and preventing fluid from exiting cylinder 22 save by outlet 32. While piston 16 moves to the left from its rightmost extension within cylinder 22, valve 25 seals cylinder 22, preventing fluid from exiting seal 22 via outlet 32. The movement of piston 16 creates a partial vacuum between piston face 21 and plug 42 of valve 25. Valve 25 is retained in a seal by seal spring 44, and by vacuum. Movement to the left by piston 16 withdraws straight shaft 18 away from port 24, unblocking and opening port 24 so that fluid can enter cylinder 22. Once port 24 is open, the vacuum is exposed to fluid, which is drawn into cylinder 22 via suction until piston 16 reaches its leftmost position. Piston 16 then travels rightward, expelling fluid through port 24 until port 24 is blocked by straight shaft 18 of piston 16. Continued rightward motion exerts pressure on fluid trapped between piston face 21 and plug 42 of valve 25, opening valve 25. Rightward motion of piston 16 from port 24 to the rightmost extension of piston 16 thus pumps fluid out of cylinder 22 via outlet 32. The total volume of fluid displaced by each cycle of cam 12 and piston 16 is determined by the distance between port 24 and the rightmost extension of straight shaft 18 of piston 16.

Shim clips 38 are inserted between cylinder 22 and base 26, adjusting the position of cylinder 22—and therefore of port 24—relative to cam 12, and the rightmost extension of straight shaft 18. Cylinder 22 is screwed tight, holding shim clips 38 in place. The interior of cylinder 22 may be threaded to allow threaded tubes and hoses to be attached at outlet 32.

As depicted, cam 12 comprises a circular disk having a geometric cam center GC displaced from axis of rotation RA, which passes through the center of driveshaft 14. Piston axis PA does not intersect rotational axis RA, but rather misses rotational axis RA by a distance discussed below, with respect to FIGS. 3 and 4. Geometric cam center GC orbits driveshaft 14 in a clockwise direction such that cam 12 forces piston 16 to the right when piston geometric cam center GC is substantially aligned with piston 16.

Figure 3A:
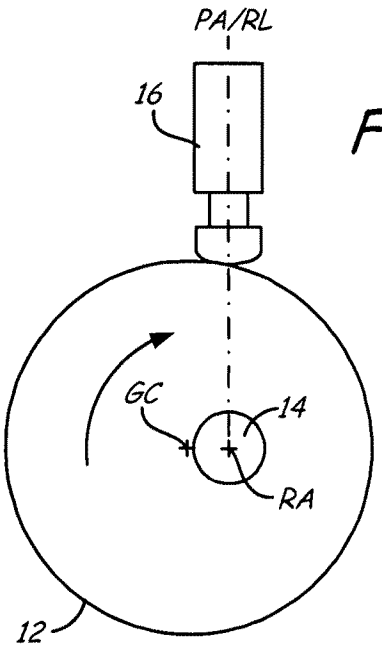
FIG. 3A PRIOR ART
FIGS. 3A and 3B are simplified views of a cam and piston of the prior art.
Figure 3B:
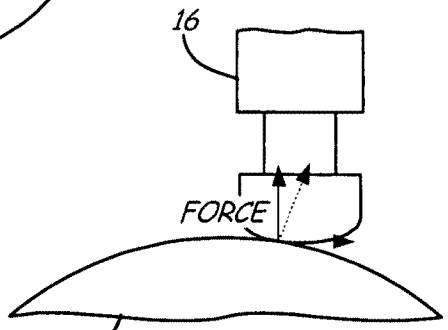
FIG. 3B PRIOR ART

FIGS. 3A and 3B depict prior art configurations of cam 12 and piston 16. FIG. 3A shows driveshaft 14 cam 12, and FIG. 3B indicates the direction of forces applied on piston 16 by cam 12. In prior art piston pumps, piston 16 is oriented directly in line with driveshaft 14, so as to extend radially outward from the axis of rotation of cam 12. The resulting force applied by cam 12 on piston 16 during compression of spring 28 is primarily along the axis of translation of piston 16, but has a component in the direction of rotation, perpendicular to the axis of translation of piston 16. This force component does no work (and therefore represents wasted energy), and may contribute to the wear of piston 16 or cylinder 22.

Figure 4A:
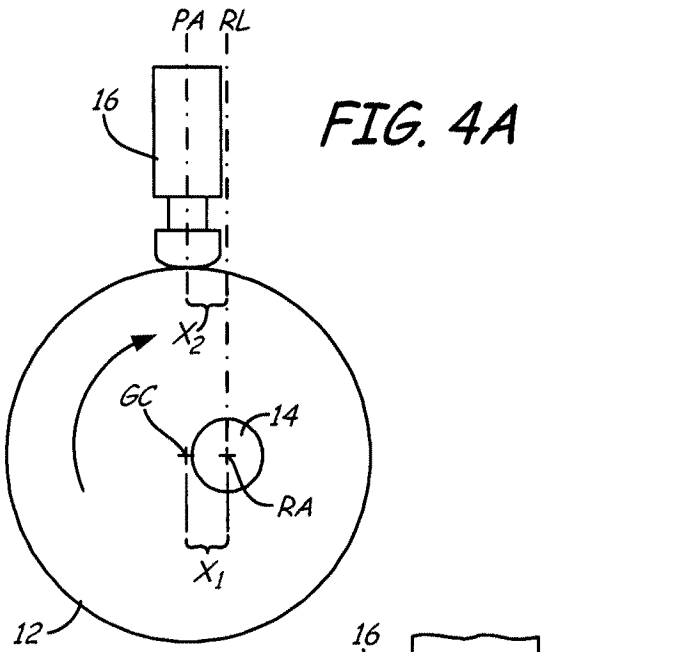
FIGS. 4A and 4B are simplified views of the cam and piston of FIGS. 1 and 2.
Figure 4B:
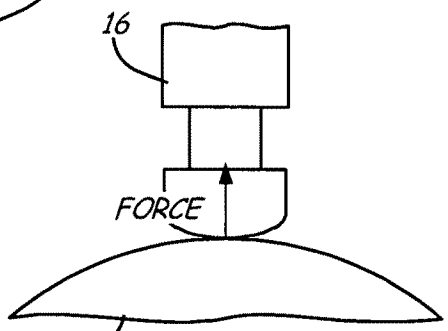

FIGS. 4A and 4B depict a configuration of the present invention for cam 12 and piston 16. FIG. 4A shows driveshaft 14 and cam 12, and FIG. 4B indicates the direction of forces applied on piston 16 by cam 12. Geometric cam center GC is separated from axis of rotation RA by a distance $X_1$. FIG. 4A shows piston axis PA, which lies in the plane of cam 12, and reference line RL, a line parallel to piston axis PA which also lies in the plane of cam 12, but which passes through axis of rotation RA of cam 12. Piston 16 is not oriented in line with driveshaft 14, as in the prior art, but rather is displaced a distance $X_2$ in a direction opposite the rotation of cam 12 and perpendicular to piston axis PA, for increased efficiency. Accordingly, piston axis PA and reference line RL are separated by distance $X_2$. In one embodiment, $X_1=X_2$. By comparison, distance $X_2$ is zero in FIG. 3A, as piston axis PA and reference line RL coincide in the prior art. If cam 12 is circular, the maximum force applied by cam 12 on piston 16 during compression of spring 28 is oriented entirely along the axis of translation of piston 16, with negligible force in any other direction. This maximum force occurs when the major axis of cam 12 is perpendicular to piston axis PA. Cam 12 may alternatively take other shapes (e.g. elliptical or some irregular shapes), in which case the displacement of piston axis PA from reference line RL will improve efficiency, but not altogether eliminate forces not in line with piston axis PA. This configuration efficiently converts rotational energy from driveshaft 14 into translational motion of piston 16, and avoids exposing piston 16 or cylinder 22 to unnecessary stresses or wears as described above with respect to FIGS. 3A and 3B.

Figure 6:
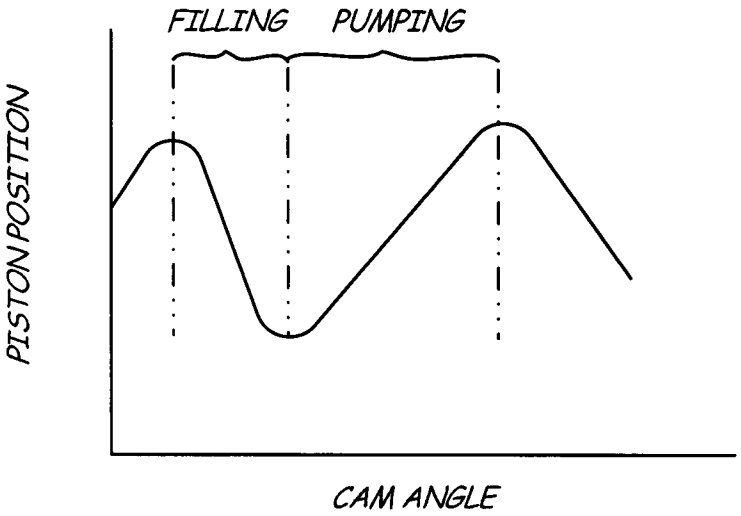
FIG. 6 is an exaggerated plot of piston position versus cam angle in the present invention.
Figure 5:
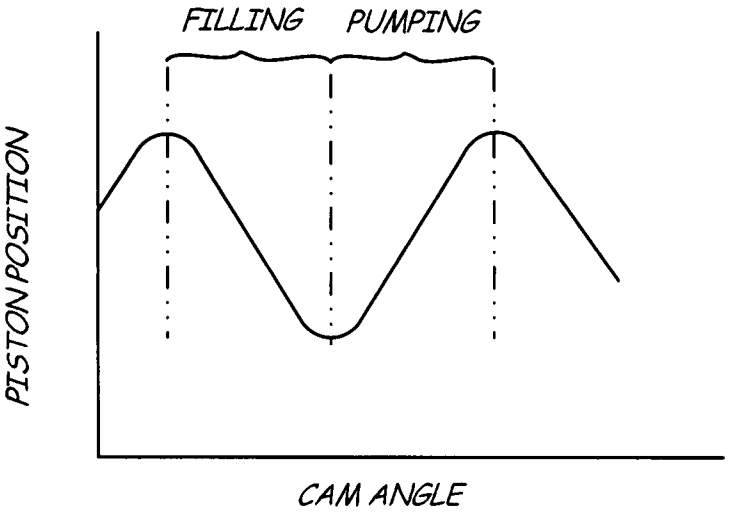
FIG. 5 PRIOR ART
FIG. 5 is a plot of piston position versus cam angle in the prior art.

The present invention also allows cam 12 to drive piston 16 through a greater range of angles of cam rotation. FIG. 5 is a plot of prior art piston position versus cam angle. In the prior art, the work cycle of a piston driven by such a circular cam is even: the piston moves in one direction for half of each rotational period of the cam, and in the opposite direction during the other half. Accordingly, prior art pump assemblies pump for half of each rotational cycle, and fill for the other half FIG. 6 is a plot of piston position versus cam angle in the present invention. FIG. 6 is exaggerated, rather than drawn to scale, so as to highlight the differences between the work cycle of the present invention and the work cycle of the prior art. In the present invention, piston 16 spends more than half of each rotational period of the cam traveling into cylinder 22, and less than half retracting from cylinder 22. Accordingly, pump assembly 10 pumps for more than half of each rotational cycle, and fills for less than half Since pump assembly 10 only performs work during pumping, this configuration enables the piston to pump the same quantity of fluid with the same driveshaft speed as the prior art, while requiring less torque than prior art configurations from driveshaft 114. More generally, pump assembly 10 may be designed to a desired pumping profile describing filling and pumping periods by displacing piston axis PA an appropriate distance from rotational axis RA.

By displacing piston 16 from in-line with the axis of rotation of cam 12, the present invention reduces wear on components of pump assembly 10, and increases pumping efficiency by minimizing wasted torque. In addition, the present invention allows piston 16 to be driven by lower torque rotation of driveshaft 14, thereby further improving energy efficiency.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump assembly comprising:

a cam with a geometric center, wherein the cam rotates in a plane about an eccentric axis offset from the geometric center by a first distance, and has a circumferential side wall; and a piston engaging the circumferential side wall of the cam, and which runs along a piston axis;

wherein the piston axis lies in the plane of the cam, and is parallel to a reference line perpendicular to the eccentric axis and intersecting the eccentric axis, but separated from the reference line by a second distance equal to the first distance.

2. The pump assembly of claim 1, wherein the cam is a circular cam.

3. The pump assembly of claim 1, further comprising a cylinder having a fluid inlet port and a fluid outlet, and through which the piston translates.

4. A pump assembly comprising:

a circular cam rotating in plane, the circular cam comprising:

an eccentric axis of rotation;

a circumferential side wall parallel to the eccentric axis of rotation; and a geometric center separated from the eccentric axis of rotation by a first distance; and a piston lying in the plane, the piston comprising:

a cam follower engaging the circumferential side wall such that rotation of the circular cam applies force on the piston; and a shaft which travels along a piston axis separated from the eccentric axis of rotation by a second distance equal to the first distance;

wherein:

the circular cam exerts a maximum force on the piston when the piston axis is perpendicular to the circumferential side wall where the cam follower engages the circumferential side wall; and the maximal force applied by the circular cam on the piston is substantially in line with the piston axis.

5. The pump assembly of claim 4, further comprising a hollow cylinder with an inlet port and an outlet, and wherein the piston travels inside the cylinder such that:

the cylinder fills with fluid through the inlet port while the piston is retracting out of the cylinder; and the piston pumps fluid out the cylinder through the outlet while the piston is extending into the cylinder.

6. The pump assembly of claim 5, wherein the piston spends a greater fraction of each revolution of the cam traveling into the cylinder than retracting from the cylinder.

7. A pump assembly comprising:

a base;

a cam mounted on the base to rotate in a plane, the cam having:

an axis of rotation;

a circumferential side wall parallel to the axis of rotation; and a geometric center displaced from the axis of rotation by a first distance;

a fluid-carrying cylinder which attaches to the base, and which has an inlet port and an outlet;

a piston situated in the fluid-carrying cylinder and driven by rotation of the cam, the piston comprising:

a shaft extending along a piston axis lying in the plane, the piston axis parallel to a reference line perpendicular to and intersecting the axis of rotation of the cam, but separated from the reference line by a second distance equal to the first distance;

a cam follower engaging the circumferential side wall;

wherein fluid enters the cylinder via the inlet port, and is expelled from the cylinder by travel of the piston through the cylinder.

8. The pump assembly of claim 7, further comprising a spring which retains the piston against the cam.

9. The pump assembly of claim 8, wherein the spring extends between the fluid-carrying cylinder and a platform on the piston.

10. The pump assembly of claim 7, wherein the force exerted by the cam on the piston is substantially in line with a single axis of translation of the piston.

* * * * *